US010434622B2

(12) United States Patent
Niwano et al.

(10) Patent No.: US 10,434,622 B2
(45) Date of Patent: Oct. 8, 2019

(54) POLISHING TOOL AND POLISHING METHOD FOR MEMBER HAVING CURVED SURFACE SHAPE

(71) Applicant: FUJIMI INCORPORATED, Kiyosu-shi, Aichi (JP)

(72) Inventors: Yutaka Niwano, Aichi (JP); Hitoshi Morinaga, Aichi (JP); Keigo Ohashi, Aichi (JP); Kazusei Tamai, Aichi (JP)

(73) Assignee: FUJIMI INCORPORATED, Kiyosu-Shi (JP)

( * ) Notice: Subject to any disclaimer, the term of this patent is extended or adjusted under 35 U.S.C. 154(b) by 20 days.

(21) Appl. No.: 15/504,772

(22) PCT Filed: Jul. 30, 2015

(86) PCT No.: PCT/JP2015/003853
§ 371 (c)(1),
(2) Date: Feb. 17, 2017

(87) PCT Pub. No.: WO2016/031142
PCT Pub. Date: Mar. 3, 2016

(65) Prior Publication Data

US 2017/0252890 A1 Sep. 7, 2017

(30) Foreign Application Priority Data

Aug. 27, 2014 (JP) ..... 2014-172977

(51) Int. Cl.

| | |
|---|---|
| ***B24B 37/22*** | (2012.01) |
| ***B24B 29/00*** | (2006.01) |
| ***B24B 37/00*** | (2012.01) |
| ***B24B 37/26*** | (2012.01) |
| ***B24D 11/00*** | (2006.01) |
| ***B24B 37/24*** | (2012.01) |
| *B24B 37/11* | (2012.01) |

(52) U.S. Cl.
CPC ..... *B24B 37/22* (2013.01); *B24B 29/00* (2013.01); *B24B 37/00* (2013.01); *B24B 37/245* (2013.01); *B24B 37/26* (2013.01); *B24D 11/00* (2013.01); *B24B 37/11* (2013.01)

(58) Field of Classification Search
CPC ..... B24B 37/11; B24B 37/12; B24B 37/14; B24B 37/16; B24B 37/20; B24B 37/205; B24B 37/22; B24B 37/24; B24B 37/245; B24B 37/26; B24B 7/30
USPC ..... 451/5, 8–10, 11, 28, 41
See application file for complete search history.

(56) References Cited

U.S. PATENT DOCUMENTS 4,263,755 A * 4/1981 Globus ..... B24D 11/00 451/490
5,222,331 A 6/1993 Manor et al.
(Continued)

FOREIGN PATENT DOCUMENTS

EP 0 919 336 A2 6/1999
JP H04-89661 U 8/1992
(Continued)

*Primary Examiner* — Robert A Rose
(74) *Attorney, Agent, or Firm* — Foley & Lardner LLP

(57) ABSTRACT

A polishing method capable of removing waviness on a resin-coated surface having a curved surface is provided. The resin-coated surface having the curved surface is polished by using a polishing pad having a polishing surface formed of a hard resin layer.

5 Claims, 6 Drawing Sheets

(56) References Cited

U.S. PATENT DOCUMENTS 5,807,161 A * 9/1998 Manor ..... B24B 23/00 451/442
6,089,966 A * 7/2000 Arai ..... B24B 37/22 257/E21.214
2002/0090901 A1 7/2002 Schutz et al.
2002/0137313 A1 9/2002 Ueno et al.
2003/0022604 A1 1/2003 Annen et al.
2003/0049995 A1 3/2003 Schutz et al.
2003/0207659 A1 11/2003 Annen et al.
2005/0020189 A1 1/2005 Annen et al.
2005/0020190 A1 1/2005 Schutz et al.
2005/0084221 A1* 4/2005 Yang ..... G02B 6/3885 385/114
2005/0262773 A1 12/2005 Schutz et al.
2005/0282470 A1* 12/2005 Steckenrider ..... B24B 37/22 451/36
2006/0135050 A1 6/2006 Petersen et al.
2006/0178099 A1* 8/2006 Hishiki ..... B24B 37/205 451/521
2008/0064302 A1* 3/2008 Fujitani ..... B24B 37/26 451/41
2013/0102231 A1* 4/2013 Joseph ..... B24B 37/22 451/59
2013/0291323 A1* 11/2013 Heilian ..... B24D 3/002 15/104.94
2016/0303708 A1* 10/2016 Yamahara ..... B24B 37/22

FOREIGN PATENT DOCUMENTS

JP H09-277159 A 10/1997
JP 2004-202668 A 7/2004
JP 2005-131720 A 5/2005
JP 2007-190678 A 8/2007
JP 2008-524000 A 7/2008
JP 2009-039855 A 2/2009
JP 2012-251099 A 12/2012
WO WO-01/078125 A1 10/2001

* cited by examiner

POLISHING TOOL AND POLISHING METHOD FOR MEMBER HAVING CURVED SURFACE SHAPE

TECHNICAL FIELD

The present invention relates to a polishing method.

BACKGROUND ART

Buffing is known as a processing method for smoothing a polishing target having a curved surface, for example, a resin-coated surface of an automobile and the like (for example, PTL 1). The buffing is a method of polishing the polishing target in such a manner that a variety of polishing agents are applied onto a circumference (surface) of a polishing wheel (buff) made of cloth or other materials and are then rotated.

CITATION LIST

Patent Literature

PTL 1: JP 2012-251099 A

SUMMARY OF INVENTION

Technical Problem

However, by the buffing, it has been impossible to remove waviness of a resin-coated surface, and it has been difficult to realize a beautiful surface finish.

It is an object of the present invention to provide a polishing method capable of removing the waviness of the resin-coated surface having the curved surface.

Solution to Problem

In order to solve the above-described problems, according to an aspect of the present invention, there is provided a polishing method including polishing a resin-coated surface having a curved surface by using a polishing pad having a polishing surface formed of a hard resin layer.

The above-described polishing method may includes allowing the polishing surface to follow the resin-coated surface. The above-described polishing method may includes allowing the polishing surface to follow the resin-coated surface by forming the polishing pad to includes a two-layer structure which includes the hard resin layer and a soft resin layer that supports the hard resin layer.

The above-described polishing method may includes allowing the polishing surface to follow the resin-coated surface by forming a groove on the polishing surface.

Moreover, pressing force of the polishing surface against the resin-coated surface may be set constant.

After the resin-coated surface is polished by the above-described polishing pad, the resin-coated surface may be polished by using a second polishing pad of which hardness is lower than hardness of the above-described hard resin layer.

Moreover, the above-described polishing method may include using slurry containing alumina abrasive grains as a polishing agent.

Advantageous Effects of Invention

In accordance with the present invention, the polishing method capable of removing the waviness of the resin-coated surface having the curved surface can be realized.

The object and advantages of the present invention are concretized and achieved by using the elements illustrated in the scope of claims and combinations of the elements. It should be interpreted that both of the above-mentioned general description and the following detailed description are merely illustrations and explanations, and do not limit the present invention like the scope of claims.

DESCRIPTION OF EMBODIMENTS

Hereinafter, embodiments of the present invention will be described in detail with reference to the drawings.

1. First Embodiment

In a polishing method according to a first embodiment, a resin-coated surface having a curved surface is polished by using a polishing pad having a polishing surface formed of a hard resin layer. The resin-coated surface may be, for example, a coated surface of a vehicle body of a vehicle or the like.

In the polishing method according to the first embodiment, for example, the polishing surface may be allowed to follow the resin-coated surface.

In the polishing method according to the first embodiment, a two-layer structure, which includes such a hard resin layer that forms the polishing surface and a soft resin layer that supports this hard resin layer, is formed in the polishing pad, whereby the polishing surface may be allowed to follow the resin-coated surface. In a case where the polishing surface is pressed against the curved surface of the resin-coated surface, then the soft resin layer is distorted depending on the curved surface, whereby the hard resin layer is warped, and the polishing surface follows the curved surface of the resin-coated surface.

Moreover, in the polishing method according to the first embodiment, the hard resin layer is supported by using an elastic member, whereby the polishing surface maybe allowed to follow the resin-coated surface. In the case where the polishing surface is pressed against the curved surface of the resin-coated surface, the elastic member is distorted, and the hard resin layer is warped depending on the curved surface, whereby the polishing surface follows the curved surface of the resin-coated surface.

Moreover, pressing force of the polishing surface against the resin-coated surface may be set constant.

Furthermore, after the polishing by the polishing pad having the polishing surface formed of the hard resin layer, the resin-coated surface may be polished by using a second polishing pad of which hardness is lower than hardness of the hard resin layer.

Moreover, in such a case of the polishing, slurry containing alumina abrasive grains may be used as such a polishing agent.

Hereinafter, the first embodiment will be described in detail.

1-1. Regarding Polishing Method

The polishing method according to the first embodiment can be used, for example, for automatic polishing of polishing the resin-coated surface having the curved surface in such a manner that the polishing pad having the polishing surface formed of the hard resin layer is attached onto an automatic polisher including a robot arm.

Figure 1:
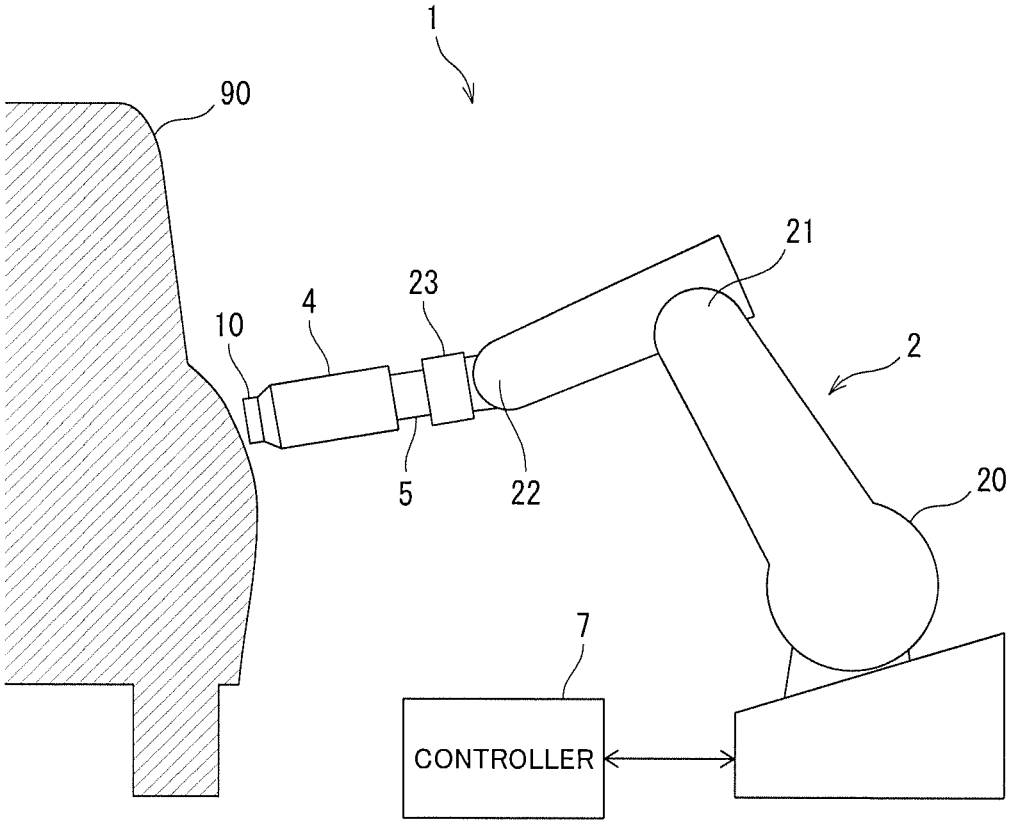
FIG. 1 is a view illustrating a configuration example of an automatic polisher that uses a polishing pad according to an embodiment of the present invention.

FIG. 1 is referred to. An automatic polisher 1 includes: a robot arm 2; a polishing pad 10; a polishing tool 4; a pressing pressure detector 5; and a controller 7. Reference numeral 90 denotes a polishing target. The polishing target 90 may be, for example, a vehicle body of an automobile or the like, in which a surface is coated with resin. The robot arm 2 has a plurality of joints 20, 21 and 22, and can move a tip end portion 23, onto which the polishing pad 10, the polishing tool 4 and the pressing pressure detector 5 are attached, in a plurality of directions.

The polishing tool 4 is attached onto the tip end portion 23 through the pressing pressure detector 5, and by driving means built in the polishing tool 4, rotates the polishing pad 10 about a direction perpendicular to the polishing surface 30, the direction being taken as a rotation axis. The controller 7 controls a behavior of the robot arm 2 and the rotation of the polishing pad 10, which is made by the polishing tool 4. From a polishing agent feeding mechanism (not shown), the polishing agent is fed between the polishing pad 10 and the polishing target 90. The controller 7 presses the polishing pad 10 against a surface of the polishing target 90 by the robot arm 2, then rotates the polishing pad 10, and thereby polishes the surface of the polishing target 90. The pressing pressure detector 5 detects pressing pressure of the polishing surface 30 against the polishing target 90. Based on a detection result by the pressing pressure detector 5, the controller 7 may adjust such force of pressing the polishing surface 30 against the polishing target 90. Based on the detection result by the pressing pressure detector 5, the controller 7 may control the robot arm 2 so that the polishing surface 30 can move across the surface of the polishing target 90 while constantly maintaining the pressing force of the polishing surface 30 against the polishing target 90.

Moreover, the polishing method according to the first embodiment is not used only for the above-described automatic polisher. For example, the polishing method according to the first embodiment may be used for a manual operation of polishing the resin-coated surface having the curved surface in such a manner that the polishing pad having the polishing surface formed of the hard resin layer is attached onto a tip end of a hand polisher.

A configuration of the polishing pad 10 is not particularly limited as long as the polishing pad 10 has the polishing surface formed of the hard resin layer. For example, the polishing pad 10 may have a structure of allowing the polishing surface of the polishing pad 10 to follow the resin-coated surface. For example, the structure of allowing the polishing surface of the polishing pad 10 to follow the resin-coated surface may have such a two-layer structure, which includes the hard resin layer that forms the polishing surface and the soft resin layer that supports this hard resin layer. In the following description, the hard resin layer that forms the polishing surface is simply written as a "hard resin layer", and the soft resin layer that supports the hard resin layer is simply written as a "soft resin layer".

1-2. Regarding Configuration Example of Polishing Pad

Figure 2A:
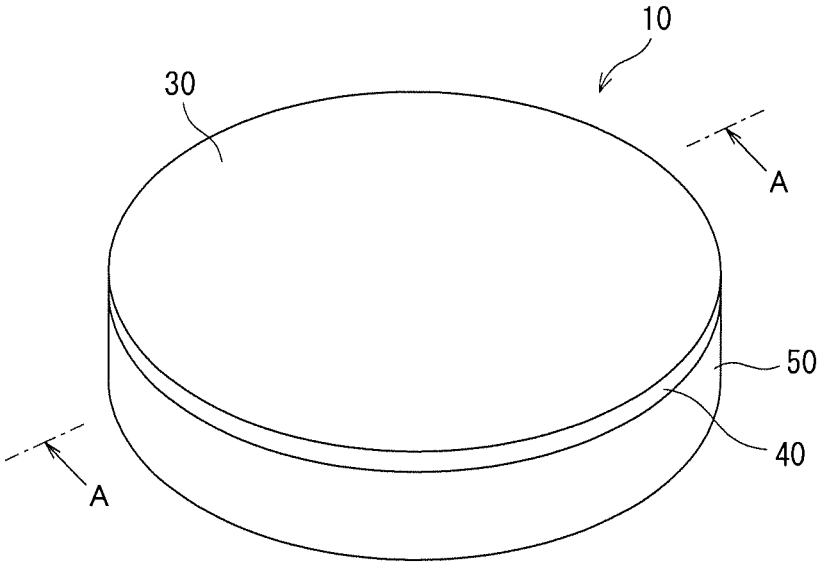
FIG. 2A is a perspective view of a polishing pad according to the embodiment of the present invention.
Figure 2B:
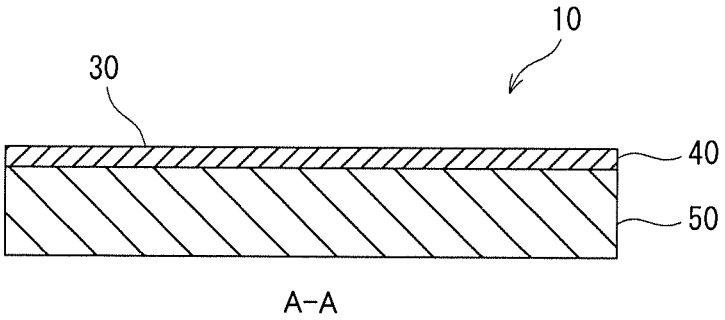
FIG. 2B is a cross-sectional view of the polishing pad illustrated in FIG. 2A, taken along a line A-A.

Hereinafter, as an example of the polishing pad 10, a configuration example of the polishing pad 10 having the two-layer structure, which includes the hard resin layer that forms the polishing surface and the soft resin layer that supports this hard resin layer, will be described. FIG. 2A and FIG. 2B are referred to. The polishing pad 10 has a two-layer structure, which includes a hard resin layer 40 and a soft resin layer 50. The hard resin layer 40 forms the polishing surface 30 of the polishing pad 10. The soft resin layer 50 supports the hard resin layer 40. In addition, in a case where the polishing surface 30 is pressed against the curved surface of the resin-coated surface, the soft resin layer is distorted depending on the curved surface. Therefore, the hard resin layer 40 is warped along the curved surface, and the polishing surface 30 follows the curved surface of the resin-coated surface.

1-3. Regarding Hard Resin Layer

In terms of A hardness defined in conformity with JIS K 6253, hardness of the hard resin layer 40 is preferably 50 degrees or more, more preferably 60 degrees or more. Moreover, the hardness of the hard resin layer 40 is preferably 95 degrees or less. For example, the hardness of the hard resin layer 40 is preferably 60 degrees or more to 80 degrees or less, or the hardness of the hard resin layer 40 is preferably 85 degrees or more to 95 degrees or less. When the hardness of the hard resin layer 40 remains within such a range, then the polishing for the curved surface of the resin-coated surface by the polishing pad 10 is less likely to become copy polishing, and it becomes possible to remove waviness of the surface of the resin-coated surface.

A thickness of the hard resin layer 40 is not particularly limited; however, is preferably 3.0 mm or less. Moreover, the thickness of the hard resin layer 40 is preferably 0.5 mm or more. When the thickness of the hard resin layer 40 remains within such a range, then in the case where the polishing surface 30 is pressed against the curved surface of the resin-coated surface, it becomes easy for the hard resin layer 40 to be warped along the curved surface of the resin-coated surface, and followability of the polishing surface 30 with respect to the curved surface of the polishing target is enhanced. Therefore, such a waviness component of a surface shape of the polishing target can be removed, and in addition, polishing efficiency is enhanced since a contact area between the polishing surface 30 and the curved surface is increased.

A material of the hard resin layer 40 is not particularly limited, and just needs to be a material having the above-described hardness. Particularly, the material of the hard resin layer 40 may be, for example, a polyurethane foam body or a nonwoven fabric. The material of the hard resin layer 40 may be, for example, a nonwoven fabric in which A hardness is 60 degrees or more to 80 degrees of less, or may be a polyurethane foam body in which A hardness is 85 degrees or more to 95 degrees or less.

1-4. Regarding Soft Resin Layer

In terms of E hardness defined in conformity with JIS K 6253, hardness of the soft resin layer 50 is preferably 30 degrees or less. When the hardness of the soft resin layer 50 remains within such a range, then it becomes easy for the soft resin layer 50 to be distorted in the case where the polishing surface 30 is pressed against the curved surface of the resin-coated surface. As a result, it becomes easy for the hard resin layer 40 to be warped along the curved surface of the resin-coated surface, and the followability of the polishing surface 30 with respect to the curved surface of the polishing target is enhanced. Therefore, the waviness component of the surface shape of the polishing target can be removed, and in addition, the polishing efficiency is enhanced since the contact area between the polishing surface 30 and the curved surface is increased.

Thickness of the soft resin layer 50 is not particularly limited; however, is preferably 5.0 mm or more. Moreover, the thickness of the soft resin layer 50 is preferably 50 mm or less. When the thickness of the soft resin layer 50 remains within such a range, a distortion amount of the soft resin layer 50 and a warp amount of the hard resin layer 40 can be ensured in the case where the polishing surface 30 is pressed against the curved surface of the resin-coated surface.

A material of the soft resin layer 50 is not particularly limited, and just needs to be a material having the above-described hardness. The material of the soft resin layer 50 may be, for example, a resin foam body such as a polyurethane foam body and a polyethylene foam body.

1-5. Regarding Polishing Agent

A description will be made of an example of the polishing agent for use in the above-described polishing method.

As the polishing agent, slurry can be used, which contains abrasive grains selected from: particles composed of an oxide of silicon or a metal element, such as silica, alumina, ceria, titania, zirconia, iron oxide and manganese oxide; organic particles composed of thermoplastic resin; and organic-inorganic composite particles.

For example, for the polishing agent, it is preferable to use alumina slurry, which enables a high polishing speed and is easily available.

As alumina, there are α-alumina, β-alumina, γ-alumina, θ-alumina and the like, which have crystal forms different from one another, and an alumina compound called hydrated alumina is also present. From a viewpoint of the polishing speed, those containing α-alumina as a main component are more preferable as the abrasive grains.

A mean particle diameter of the abrasive grains is preferably 0.1 μm or more, more preferably 0.3 μm or more. As the mean particle diameter is becoming larger, the polishing speed is enhanced. In a case where the mean particle diameter remains within the above-described range, it becomes easy to enhance the polishing speed to a level that is particularly suitable for practical use.

Moreover, the mean particle diameter is preferably 10.0 μm or less, more preferably 5.0 μm or less. As the mean particle diameter is becoming smaller, dispersion stability of the polishing agent is enhanced, and a scratch is suppressed from occurring on the polishing surface.

In such a case where the mean particle diameter remains within the above-described range, it becomes easy to enhance the dispersion stability of the polishing agent and surface accuracy of the polishing surface to levels which are particularly suitable for practical use. Note that the mean particle diameter of the abrasive grains can be measured by a pore electrical resistance method (Coulter principle) method (measuring machine: Multisizer Type-III made by Beckman Coulter, Inc.).

A content of the abrasive grains in the polishing agent is preferably 0.1 mass % or more, more preferably 0.2 mass % or more, still more preferably 0.5 mass % or more. As the content of the abrasive grains is becoming larger, the polishing speed is enhanced. In a case where the content of the abrasive grains remains within the above-described range, it becomes easy to enhance the polishing speed to the level that is particularly suitable for practical use.

Moreover, the content of the abrasive grains is preferably 50 mass % or less, more preferably 25 mass % or less, still more preferably 20 mass % or less. In a case where the content of the abrasive grains remains within the above-described range, cost of the polishing agent can be suppressed. Moreover, a surface defect can be further suppressed from occurring on the surface of the polishing target already polished by the polishing agent.

Besides the above-described abrasive grains, the polishing agent may appropriately contain other components such as lubricating oil, an organic solvent, a surfactant, and a thickener.

The lubricating oil may be synthetic oil, mineral oil, vegetable oil, or a combination of these.

The organic solvent may be alcohol, ether, glycols or glycerins as well as a hydrocarbon-based solvent.

The surfactant may be so-called anion, cation, nonion or amphoteric surfactant.

The thickener may be a synthetic thickener, a cellulose thickener, or a natural thickener.

1-6. Regarding Effects of First Embodiment

In the polishing method of the first embodiment, the polishing pad having the polishing surface formed of the hard resin layer is used for polishing the resin-coated surface. Therefore, in comparison with the soft polishing surface, the polishing for the resin-coated surface is less likely to become copy polishing. As a result, the waviness component of the surface shape of the resin-coated surface can be removed.

Moreover, the polishing method of the first embodiment uses the polishing pad 10 provided with the structure of allowing the polishing surface 30 to follow the curved surface of the resin-coated surface. Therefore, the polishing surface 30 follows the curved surface of the resin-coated surface, and accordingly, the waviness component of the surface shape of the polishing target can be removed. In addition, the polishing efficiency is enhanced since the contact area of the polishing surface 30 in contact with the resin-coated surface having the curved surface is increased, and a time required to polish such a relatively large resin-coated surface can be shortened.

Figure 3A:
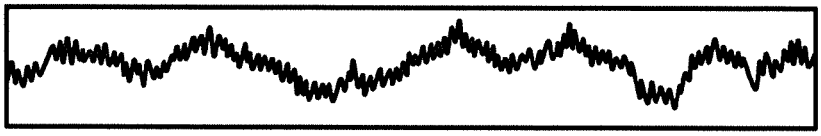
FIG. 3A is an explanatory view of a surface shape of an unpolished resin-coated surface.
Figure 3B:
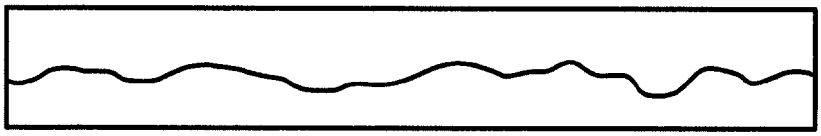
FIG. 3B is an explanatory view of a surface shape of an already buffed resin-coated surface, the surface shape being taken as a comparative example.
Figure 3C:
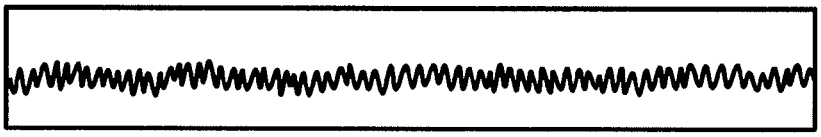
FIG. 3C is an explanatory view of a surface shape of the resin-coated surface already polished by a polishing pad of FIG. 2A.

FIG. 3A to FIG. 3C are referred to. FIG. 3A schematically shows a profile of the surface shape of the unpolished resin-coated surface. The unpolished surface shape has a surface roughness component with a relatively high frequency and a waviness component with a relatively low frequency.

FIG. 3B shows a profile of a surface shape of an already buffed resin-coated surface as a comparative example. In such buffing, hardness of polishing cloth is relatively low, and the copy polishing is brought about. Therefore, though the surface roughness component is removed, the waviness component still remains even after the polishing.

FIG. 3C schematically shows a profile of the surface shape of the resin-coated surface already polished by the polishing pad 10 of the first embodiment. The polishing surface 30 is formed of the hard resin layer 40, and accordingly, the polishing for the surface of the resin-coated surface is less likely to become the copy polishing. Therefore, the waviness component of the surface shape of the resin-coated surface is removed.

1-7. Regarding Secondary Polishing

Note that, in a case of removing a fine surface roughness component after the polishing performed by the polishing pad 10, secondary polishing of removing the surface roughness component may be performed after such primary polishing performed by the polishing pad 10. In this case, after the polishing performed by the polishing pad 10, for example, the polishing pad attached onto the polishing tool 4 shown in FIG. 1 is replaced, and the surface of the polishing target 90 is polished by using a polishing pad having lower hardness than the hardness of the hard resin layer 40 of the polishing pad 10.

In terms of A hardness, for example, the hardness of the polishing pad for use in the secondary polishing is preferably less than 50 degrees, more preferably 40 degrees of less.

Moreover, the hardness of the polishing pad for use in the secondary polishing is preferably 30 degrees or more. When the hardness of the polishing pad remains within such a range, it becomes possible to remove the fine surface roughness component on the surface of the resin-coated surface.

Figure 3D:
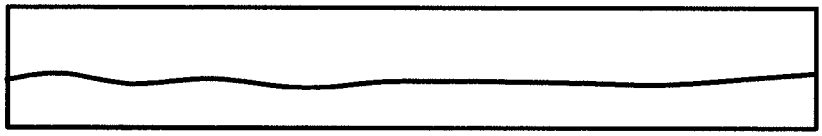
FIG. 3D is an explanatory view of a surface shape of the resin-coated surface already subjected to secondary polishing.

FIG. 3D schematically shows a profile of a surface shape of the resin-coated surface already subjected to the secondary polishing. By the polishing performed by the polishing pad 10 and the secondary polishing subsequent thereto, both of the surface roughness and waviness of the resin-coated surface are removed.

A material of the polishing pad for use in the secondary polishing is not particularly limited, and just needs to be a material having the above-described hardness. The material of the polishing pad for use in the secondary polishing may be, for example, nonwoven fabric or suede. For example, the material of the polishing pad for use in the secondary polishing may be suede in which A hardness is 30 degrees or more to 40 degrees or less.

The polishing pad for use in the secondary polishing may have a two-layer structure in a similar way to the polishing pad 10. That is to say, the polishing pad for use in the secondary polishing may have a two-layer structure including: a relatively hard first layer that forms the polishing surface; and a relatively soft second layer that supports the first layer.

Hardness of the first layer is preferably lower than the hardness of the hard resin layer 40 of the polishing pad 10. In terms of A hardness, for example, the hardness of the first layer is preferably less than 50 degrees, more preferably 40 degrees of less. Moreover, the hardness of the first layer is preferably 30 degrees or more.

Thickness of the first layer is preferably 3.0 mm or less. Moreover, the thickness of the first layer is preferably 0.5 mm or more. When the thickness of the first layer remains within such a range, then in the case where the polishing surface is pressed against the curved surface of the resin-coated surface, it becomes easy for the first layer to be warped along the curved surface of the resin-coated surface, the contact area between the polishing surface and the curved surface is increased, and the polishing efficiency is enhanced.

A material of the first layer is not particularly limited, and just needs to be a material having the above-described hardness. The material of the first layer may be, for example, nonwoven fabric or suede. For example, the material of the first layer may be suede in which A hardness is 30 degrees or more to 40 degrees or less.

A configuration of the second layer may be similar to the configuration of the soft resin layer 50 of the polishing pad 10.

1-8. Modification Example

The structure of the polishing pad 10 is not limited to the two-layer structure shown in FIG. 2A and FIG. 2B. The polishing pad 10 just needs to include such a hard resin layer that forms the polishing surface 30. For example, the polishing pad 10 does not have to include the soft resin layer for supporting the hard resin layer that forms the polishing surface 30.

In this case, the controller 7 shown in FIG. 1 may control the robot arm 2 so that the polishing surface 30 can move along the curved surface of the surface of the polishing target 90. The robot arm 2 is controlled so that the polishing surface 30 can move along the curved surface of the surface of the polishing target 90, whereby the waviness of the surface of the polishing target 90 can be removed by the polishing surface 30 formed of the hard resin layer.

2. Second Embodiment

Subsequently, a second embodiment of the present invention will be described. In a polishing method according to the second embodiment, the polishing surface is allowed to follow the resin-coated surface by using a polishing pad, in which grooves are formed on the polishing surface, as the polishing pad 10 shown in FIG. 1. The grooves are formed on the polishing surface, whereby it becomes easy for the polishing surface to follow the curved surface of the resin-coated surface in the case where the polishing surface is pressed against the curved surface of the resin-coated surface.

The grooves as described above can be formed by removing the resin layer of portions, which serve as the grooves, by etching and the like, for example, after forming the two-layer structure including the hard resin layer and the soft resin layer, however, the present invention is not limited thereto. Moreover, the grooves can be formed by scanning the surface of the pad by a circular cutting blade while pressing the circular cutting blade, which rotates at high speed, against the pad by a predetermined amount after forming the two-layer structure.

2-1. Form of Grooves

Figure 4A:
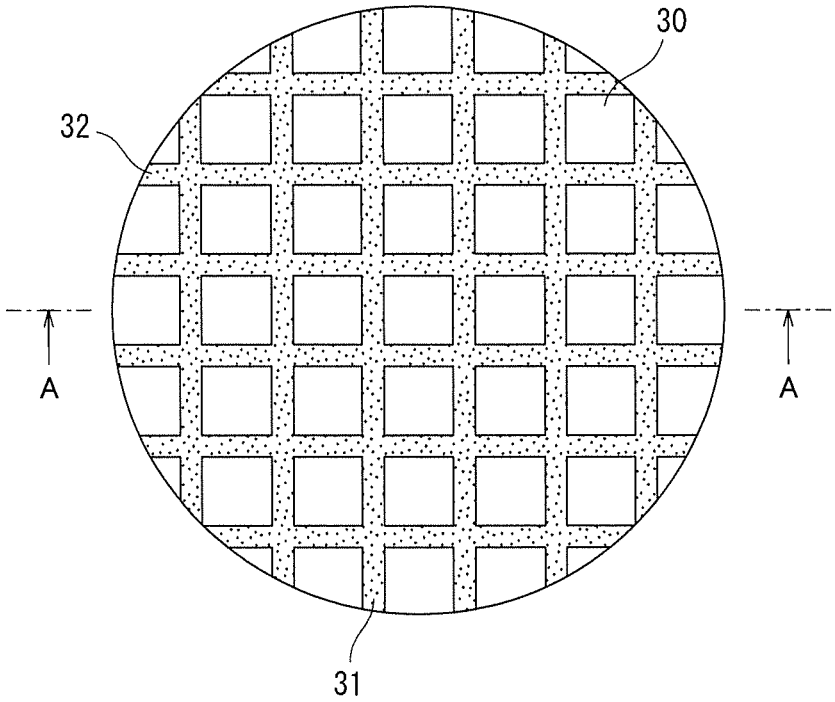
FIG. 4A is a top view of a polishing pad according to a second embodiment of the present invention.
Figure 4B:
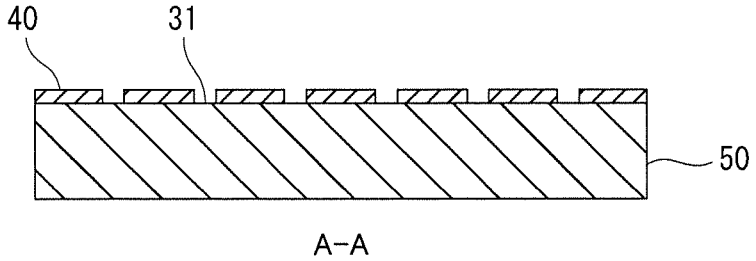
FIG. 4B is a cross-sectional view of the polishing pad illustrated in FIG. 4A, taken along a line A-A.

FIG. 4A and FIG. 4B are referred to. The same reference numerals are assigned to constituents having the same functions as those in FIG. 2A. First grooves 31 and second grooves 32 are formed on the polishing surface 30 of the polishing pad 10. The first grooves 31 are extended in a first direction on the polishing surface 30, and the second grooves 32 are extended along a second direction on the polishing surface 30, which is perpendicular to the first direction. A plurality of the first grooves 31 and a plurality of the second grooves 32 are formed on the polishing surface 30, whereby the grooves are formed in a grid shape on the polishing surface 30.

A depth of the first grooves 31 and the second grooves 32 may be the same as the thickness of the hard resin layer 40. That is to say, the hard resin layer 40 may be divided into a plurality of pieces by the first grooves 31 and the second grooves 32. Moreover, the first grooves 31 and the second grooves 32 are formed on only the hard resin layer 40, and are not formed on the soft resin layer 50. The hard resin layer 40 is divided by the first grooves 31 and the second grooves 32, whereby it becomes possible for the hard resin layer 40 to be displaced in an abutting direction depending on the curved surface of the resin-coated surface in the case where the polishing surface 30 is pressed against the curved surface of the resin-coated surface. Therefore, it becomes easy for the polishing surface 30 to follow the curved surface of the resin-coated surface.

A groove width of the first grooves 31 and the second grooves 32 is preferably 0.5 mm or more for example. Moreover, the groove width of the first grooves 31 and the second grooves 32 is preferably 5.0 mm or less for example.

When the groove width remains within such a range, it can become easy for the polishing surface 30 to be warped since a displacement amount of the hard resin layer 40 in the case where the polishing surface 30 is pressed against the curved surface of the resin-coated surface is ensured while suppressing a decrease of the contact area between the polishing surface 30 and the resin-coated surface, the decrease being caused by forming the grooves.

A pitch of the first grooves 31 and a pitch of the second grooves 32 are preferably 5.0 mm or more for example. Moreover, the pitch of the first grooves 31 and the pitch of the second grooves 32 are preferably 50 mm or less for example.

When the pitches remain within such a range, a warp amount of the whole of the polishing surface 30 in the case where the polishing surface 30 is pressed against the curved surface of the resin-coated surface can be ensured while suppressing the decrease of the contact area between the polishing surface 30 and the resin-coated surface, the decrease being caused by forming the grooves.

Dimensions of these groove width and pitches are also applied to first to third modification examples to be described below.

2-2. Regarding First Modification Example

Figure 5A:
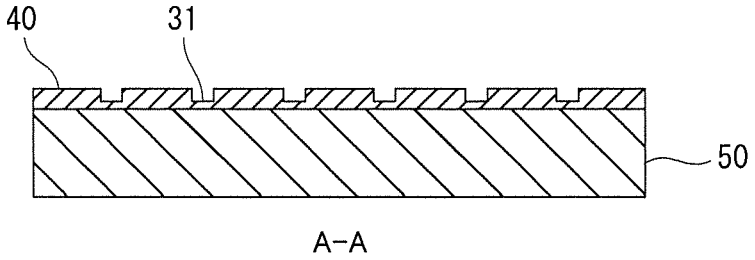
FIG. 5A is a cross-sectional view of a first modification example illustrated in FIG. 4A.

FIG. 5A is referred to. The depth of the first grooves 31 and the second grooves 32 may be smaller than the thickness of the hard resin layer 40. That is to say, the hard resin layer 40 is not divided into the plurality of pieces by the first grooves 31 and the second grooves 32, and a thickness of the hard resin layer 40 of portions of the first grooves 31 and the second grooves 32 is thinner than a thickness of other portions. Rigidity of the portions of the first grooves 31 and the second grooves 32 is decreased, and accordingly, it becomes easy for the hard resin layer 40 to be warped. Therefore, it becomes easy for the polishing surface 30 to follow the curved surface of the resin-coated surface.

2-3. Regarding Second Modification Example

Figure 5B:
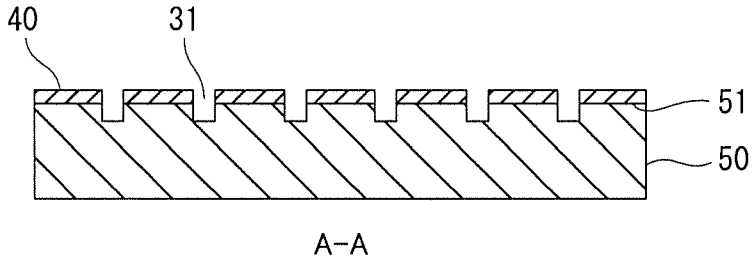
FIG. 5B is a cross-sectional view of a second modification example of the polishing pad illustrated in FIG. 4A.

FIG. 5B is referred to. The depth of the first grooves 31 and the second grooves 32 may be larger than the thickness of the hard resin layer 40. That is to say, the first grooves 31 and the second grooves 32 may be formed in the hard resin layer 40 and the soft resin layer 50. Hence, a support surface 51 of the soft resin layer 50, which supports the hard resin layer 40, is also divided by the first grooves 31 and the second grooves 32. A plurality of the divided hard resin layers 40 are supported individually by a plurality of the divided support surfaces 51.

The first grooves 31 and the second grooves 32 are also formed in the soft resin layer 50, and accordingly, rigidity of the soft resin layer 50 is decreased, and it becomes easy for the soft resin layer 50 to be distorted depending on the curved surface in the case where the polishing surface 30 is pressed against the curved surface of the resin-coated surface. Moreover, the support surface 51 that supports the hard resin layer 40 is divided, whereby binding force between the support surfaces 51 is decreased, and it becomes easy for the divided hard resin layers 40 to be displaced independently of one another. Therefore, the displacement amount of the hard resin layer 40 in the abutting direction is increased, and it becomes easy for the polishing surface 30 to follow the curved surface of the resin-coated surface.

2-4. Regarding Third Modification Example

Figure 6A:
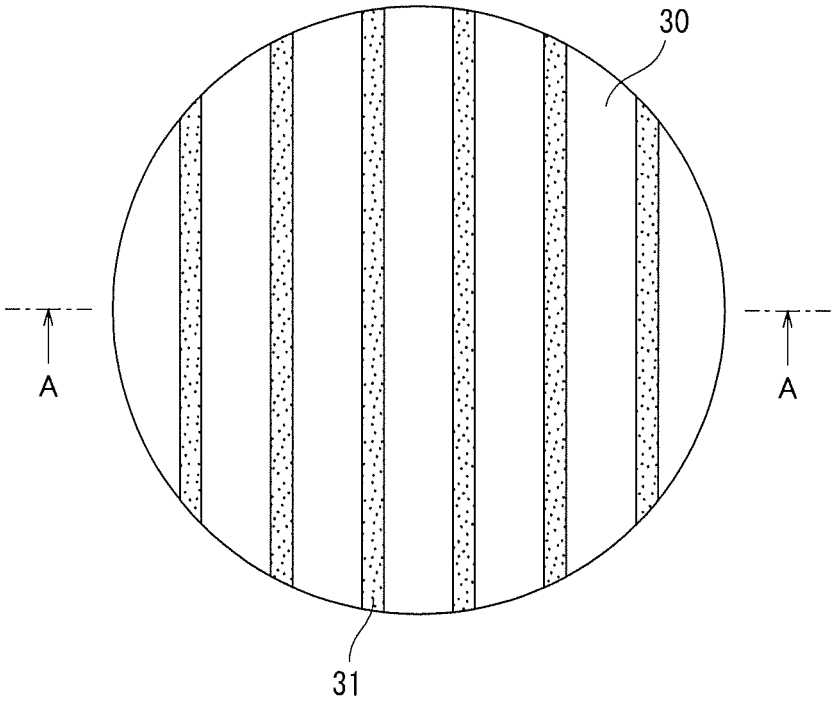
FIG. 6A is a top view of a third modification example illustrated in FIG. 4A.
Figure 6B:
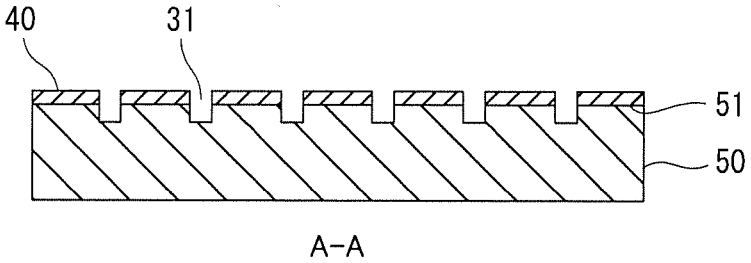
FIG. 6B is a cross-sectional view of the polishing pad illustrated in FIG. 6A, taken along a line A-A.

FIG. 6A and FIG. 6B are referred to. On the polishing surface 30, only the first grooves 31 are formed, and the second grooves 32 are not formed. The plurality of first grooves 31 are formed on the polishing surface 30, whereby the grooves are formed in a stripe shape on the polishing surface 30.

The depth of the first grooves 31 may be larger than the thickness of the hard resin layer 40. That is to say, the first grooves 31 maybe formed in the hard resin layer 40 and the soft resin layer 50. Hence, the support surface 51 of the soft resin layer 50, which supports the hard resin layer 40, is also divided by the first grooves 31. The plurality of divided hard resin layers 40 are supported individually by the plurality of divided support surfaces 51. Note that the depth of the first grooves 31 maybe the same as or smaller than the thickness of the hard resin layer 40.

The second grooves 32 are omitted, and the grooves in a stripe shape are formed on the polishing surface 30, whereby strength of the polishing surface can be enhanced, and a number of man-hours for forming the grooves is reduced, resulting in contribution to cost reduction. Moreover, the first grooves 31 are also formed in the soft resin layer 50, whereby a decrease of the followability of the polishing surface 30, which is caused since the second grooves 32 extended in the second direction are not formed, is reduced.

Note that grooves may also be formed on the polishing surface of the polishing pad for use in the secondary polishing in a similar way to the polishing pad 10 according to the second embodiment.

3. Example

A hard resin layer, in which a thickness is 1.5 mm, a material is a polyurethane foam body, and A hardness is 90, and a soft resin layer, in which a thickness is 30.0 mm, a material is a polyurethane foam body, and E hardness is 20, were laminated on each other to form a polishing pad, and a resin-coated surface thereof was polished. On the hard resin layer, grid-like grooves, in which a width is 2.0 mm, a pitch is 20.0 mm, and a depth is 3.0 mm, were formed by scanning a surface of the pad by a circular cutting blade while pressing the circular cutting blade, which rotates at a high speed, against the pad by a predetermined amount after forming such a two-layer structure. Moreover, alumina slurry was used as a polishing agent.

As a result, a finish of a flat glossy surface, in which arithmetic mean waviness (Wa) is 0.05 μm or less, and filterable maximum waviness (Wcm) is 0.3 μm or less, was able to be realized.

All the examples and conditional terms, which are described herein, are intended for instructive purposes for helping readers understand the present invention and a concept thereof given by the inventors for the progress of the technology. The present invention should be interpreted without being limited to the examples and the conditions, which are specifically described above, and to the configurations of the examples in this specification, which are related to exemplification of superiority and inferiority of the present invention. While the embodiments of the present invention have been described in detail, it should be understood that it is possible to add various changes, substitutions, and modifications to the present invention without departing from the spirit and scope of the present invention.

REFERENCE SIGNS LIST

1 automatic polisher
2 robot arm
4 polishing tool
5 pressing pressure detector
7 controller
10 polishing pad
30 polishing surface
31 first groove
32 second groove
40 hard resin layer
50 soft resin layer
51 support surface

The invention claimed is:

1. A polishing method comprising:

polishing a resin-coated surface having a curved surface by using a polishing pad having a polishing surface formed of a hard resin layer, the polishing pad having a radius smaller than each of dimensions of the resin-coated surface in a plurality of directions along the resin-coated surface, wherein the polishing surface is allowed to follow the resin-coated surface by forming the polishing pad to include a two-layer structure which includes the hard resin layer and a soft resin layer that supports the hard resin layer, and a hardness of the soft resin layer is 30 degrees or less in terms of E hardness defiled in conformity with JIS K 6253.

2. The polishing method according to claim 1, comprising allowing the polishing surface to follow the resin-coated surface by forming a groove on the polishing surface.

3. The polishing method according to claim 1, wherein pressing force of the polishing surface against the resin-coated surface is constant.

4. The polishing method according to claim 1, comprising polishing the resin-coated surface by using a second polishing pad of which hardness is lower than hardness of the hard resin layer, after the resin-coated surface is polished by the polishing pad.

5. The polishing method according to claim 1, comprising using slurry containing alumina abrasive grains as a polishing agent.

* * * * *